United States Patent [19]

Sasaki et al.

[11] Patent Number: 4,539,242

[45] Date of Patent: Sep. 3, 1985

[54] PILE FABRIC WITH NON-MUSHROOM SHAPED CUT ENDS

[75] Inventors: Yoshiyuki Sasaki, Takatsuki; Shigenobu Kobayashi, Toyonaka; Tetsuo Okamoto, Ibaraki; Norihiro Minemura, Takatsuki, all of Japan

[73] Assignee: Teijin Limited, Osaka, Japan

[21] Appl. No.: 617,593

[22] Filed: Jun. 5, 1984

[30] Foreign Application Priority Data

Jun. 7, 1983 [JP] Japan ..... 58-100144
Jun. 10, 1983 [JP] Japan ..... 58-102841

[51] Int. Cl.[3] ..... B32B 3/02

[52] U.S. Cl. ..... 428/92; 26/2 R; 26/8 R; 28/159; 428/93

[58] Field of Search ..... 428/92, 85, 93; 26/2 R, 26/8 R; 28/159

[56] References Cited

U.S. PATENT DOCUMENTS 4,340,631 7/1982 Endo ..... 428/92

*Primary Examiner*—Marion E. McCamish
*Attorney, Agent, or Firm*—Burgess, Ryan & Wayne

[57] ABSTRACT

A cut pile fabric such as a velvet composed of a synthetic fiber pile having deep color shade and smooth touch on its pile surface, the piles thereof having non-mushroom shaped cut ends at their tip portions, defined by the equation $d_1/d_2 \leqq 1.3$, where $d_1$ is the maximum diameter of the tip portion and $d_2$ is a diameter of the remaining portion of the piles. The pile fabric is obtained by utilizing, as a pile yarn, a synthetic yarn having a breakage strength of less than 2.8 g/De, a primary yielding strength of more than 1.2 g/De, a breakage elongation of less than 50%, and a primary yielding elongation of less than 10%. Such synthetic yarn can advantageously be prepared by a crystallization drawing process.

12 Claims, 34 Drawing Figures

PILE FABRIC WITH NON-MUSHROOM SHAPED CUT ENDS

BACKGROUND OF THE INVENTION

1. Field of the Invention

The present invention relates to pile fabric made of synthetic yarn, especially in a pile portion, having a good appearance with a deep color shade and a smooth surface touch and a method for producing the same.

2. Description of the Prior Art

Pile fabrics are a kind of woven or knitted fabric provided with a plurality of piles on a surface thereof. Pile fabrics have a unique appearance with elegant luster and deep color shade as well as a smooth surface touch. In the old days, pile fabrics, especially the pile portion thereof, were made exclusively from silk, rayon, acetate, or cotton. These materials, however, had functional drawbacks such as weak color fastness or lack of crease resistance. Accordingly, they have recently been replaced by synthetic fibers such as polyester or polyamide.

When synthetic fiber is utilized for a pile portion, however, other problems arise in the manufacturing process of the pile fabric. In the raising process, the piles cannot be raised uniformly or, if a double loom is utilized, the piles tend to be cut irregularly in the weaving process, resulting in an uneven pile surface.

In these cases, the thus treated fabric is often subjected to a further shearing process to cut off the tips of the piles so as to even the height. In the shearing process, however, the tips of the cut piles tend to deform in a mushroom shape, as shown in FIGS. 1*a* and 1*b*. The mushroom shaped tip portions result in a pile surface with a rough touch. The rough tips also scatter light falling on the pile surface, deteriorating the color depth unique to the cut pile product. Moreover, since foreign matter such as dust easily adheres to the rough tips, the resultant pile fabric quickly becomes dirty.

SUMMARY OF THE INVENTION

It is an object of the present invention to provide a pile fabric free from the above drawbacks of the prior art, especially, to provide a cut pile fabric comprising a pile yarn of synthetic fiber, having a good appearance with an elegant luster and a deep color shade on a pile surface as well as excellent properties in color fastness and crease resistance.

It is another object of the present invention to provide a method for producing the above pile fabric by improving the original properties of the pile forming yarn so that the cut ends thereof do not deform to a mushroom shape and the pile yarn keeps its linearity even after being subjected to a post heat-treatment such as dyeing.

The above objects are achieved by a pile fabric according to a first aspect of the present invention comprising a plurality of piles of thermoplastic synthetic fiber, at least 50% of the piles being a cut pile having a cut end at a tip portion thereof, characterized in that an average value of the maximum diameter $d_1$ of the tip portion of the cut pile satisfies the equation $$d_1/d_2 \leqq 1.3$$

where $d_2$ stands for an average value of a diameter of the remaining portion of the cut pile other than the tip portion.

The above fabric according to the present invention can be obtained by a method characterized by comprising steps of: weaving or knitting an original fabric by utilizing, as a pile forming yarn, a thermoplastic synthetic yarn having a breakage strength of less than 2.8 g/De, a primary yielding strength of more than 1.2 g/De, a breakage elongation of less than 50%, and a primary yielding elongation of less than 10%; and shearing piles of the original fabric.

According to another aspect, the pile of the pile fabric according to the present invention preferably has a deformation factor D satisfying the equation $$D/0.9\ L \leqq 0.1,$$

where the deformation factor D is the maximum distance between a chord and an arc, both connecting a tip point P and a middle point Q of the cut pile, the point Q being distant from the tip point P toward a bottom point R of the cut pile at a length of 0.9 L, wherein L corresponds to a height of the cut pile measured from the points P and R.

BRIEF DESCRIPTION OF THE DRAWINGS

Other advantages and features of the present invention will be apparent from the description of the preferred embodiments with reference to the accompanying drawings, wherein:

FIGS. 4*a* and 4*b* are microscopic photographs of one example of tip portions of cut piles according to the present invention, in which FIG. 4*b* is an enlargement of FIG. 4*a;*

DESCRIPTION OF THE PREFERRED EMBODIMENTS

According to a first aspect of the present invention, the pile fabric comprises a thermoplastic synthetic yarn at least in the pile portion and more than 50% cut piles in the piles, each cut pile having a cut end at a tip portion thereof. This means the present invention does not include a loop pile product or a raised product obtained merely by lightly napping the pile surface of the fabric. The present invention further does not include a cut pile fabric having cut piles of irregular height, such as raised fabric finished without a shearing treatment or of sliver knit. It is difficult to improve the appearance of the pile surface of such a fabric even if the technique of the present invention is applied.

All cut piles of the fabric according to the present invention preferably are of uniform height. In the extreme case, it is necessary that at least the maximum height piles be given exactly the same height as each other, for example, by the application of a shearing process or other known manner.

Figure 1A:
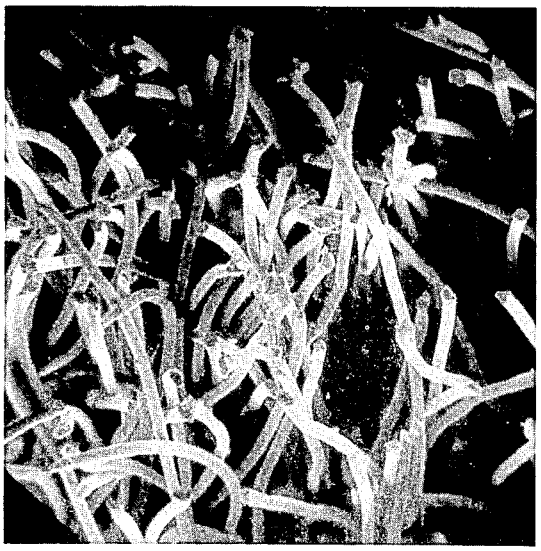
FIG. 1*a* is a microscopic photograph showing tip portions of conventional cut piles.
Figure 1B:
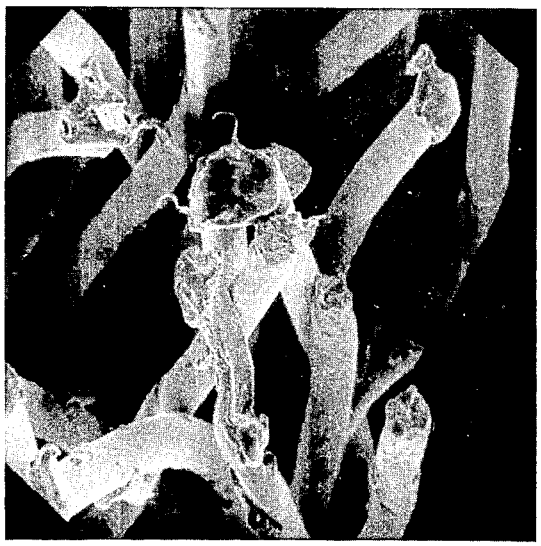
FIG. 1*b* is an enlarged photograph of part of FIG. 1*a;*
Figure 2:
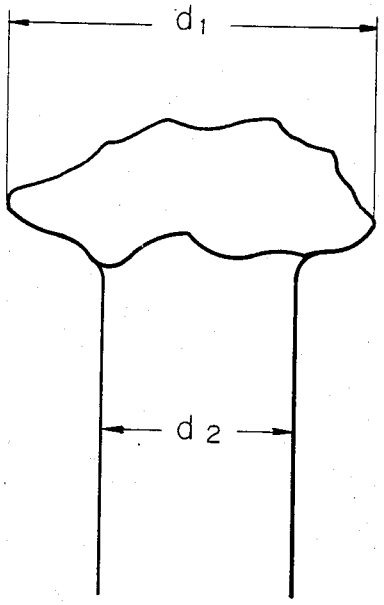
FIG. 2 is a schematic side view of a tip portion of a conventional cut pile.

It is important for the pile fabric according to the present invention that a ratio of the maximum diameter $d_1$ of the cut end portion of the pile relative to a diameter $d_2$ of the remaining portion of the pile satisfy the equation $$d_1/d_2 \leqq 1.3$$

as shown in FIG. 2.

The cross-section of the cut end portion is not always circular. However, for simple measurement, the apparent width observed from a microscopic photograph may be assumed as the diameter. At least 10 samples are necessary for deriving one average value of $d_1/d_2$ in order to compensate for fluctuations of the measured value of the diameters.

According to experiments conducted by the present inventors, the present invention is effective only in the case that the value of $d_1/d_2$ does not exceed 1.3. Moreover, a more excellent pile surface of good touch and elegant luster can be obtained if the value of $d_1/d_2$ is less than 1.15.

As is apparent from FIGS. 5*a* to 5*d* and Table 1, the cut pile of the present invention exhibits results superior to the prior art. The cut piles of the present invention prepared by crystallization drawing of cation dyeable polyester filament, described later, are shown in photographs of FIGS. 5*c* and 5*d*. The cut piles of the prior art prepared by normal drawing of the same filament are shown in photographs of FIGS. 5*a* and 5*b*. The values $d_1/d_2$ were calculated by observation of the photographs and are listed in Table 1.

TABLE 1

| | Prior art | | Present invention | |
|---|---|---|---|---|
| FIG. No. | 5a | 5b | 5c | 5d |
| $d_1/d_2$ | 1.66 | 1.37 | 0.93 | 1.22 |

Figure 3:
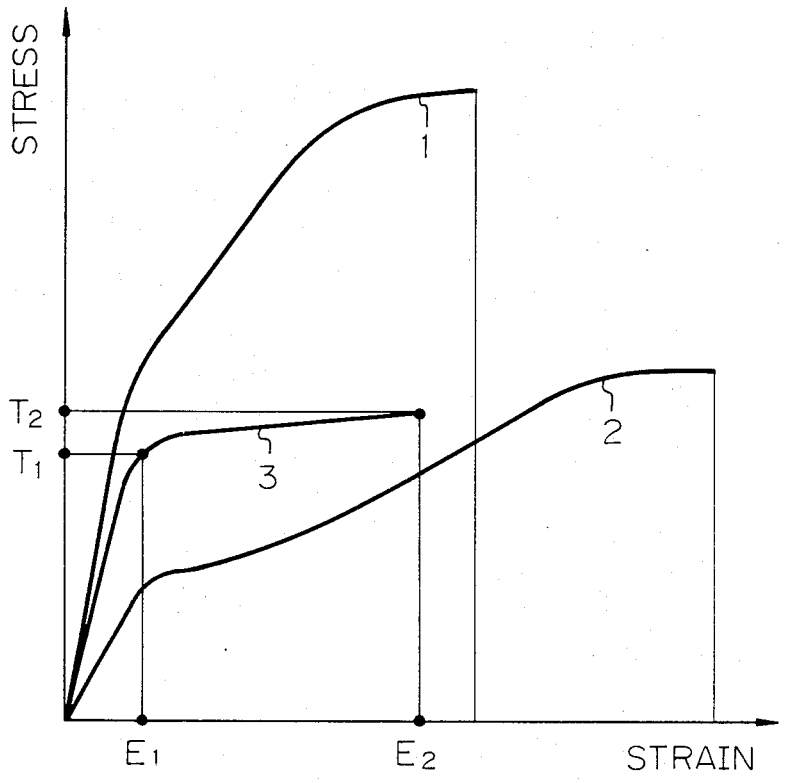
FIG. 3 is a graph of stress-strain curves of various pile yarns.
Figure 4A:
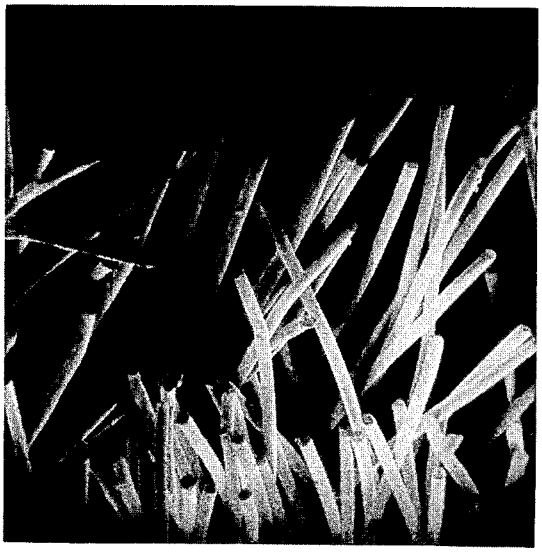
Figure 4B:
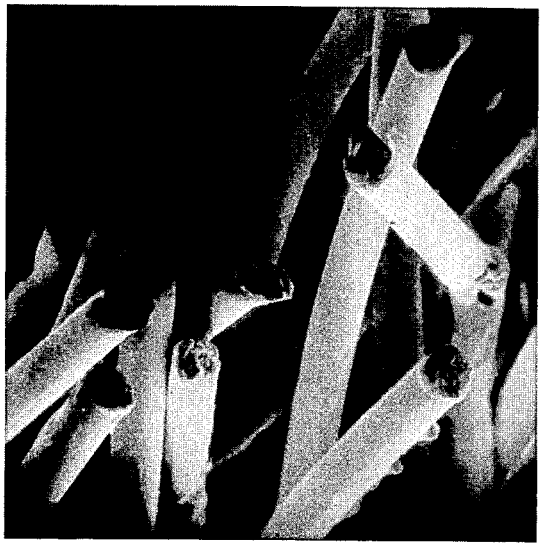
Figure 5A:
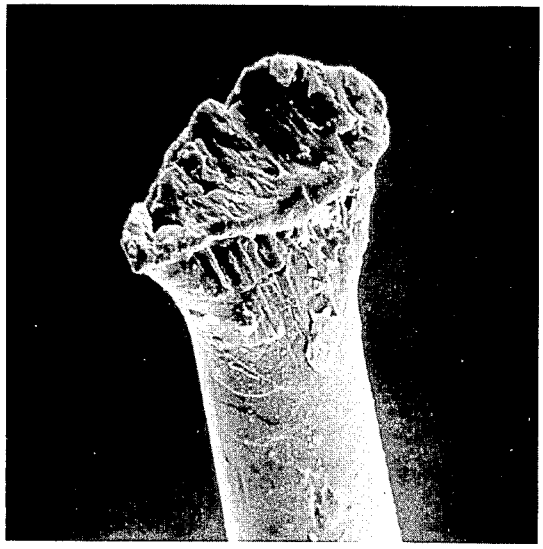
FIGS. 5*a* and 5*b* are microscopic photographs of tip portions of cut piles of cation-dyeable polyester filaments prepared in the conventional manner.
Figure 5B:
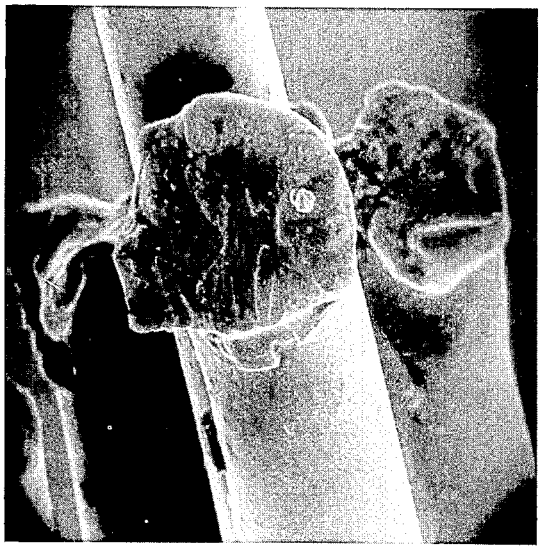
Figure 5C:
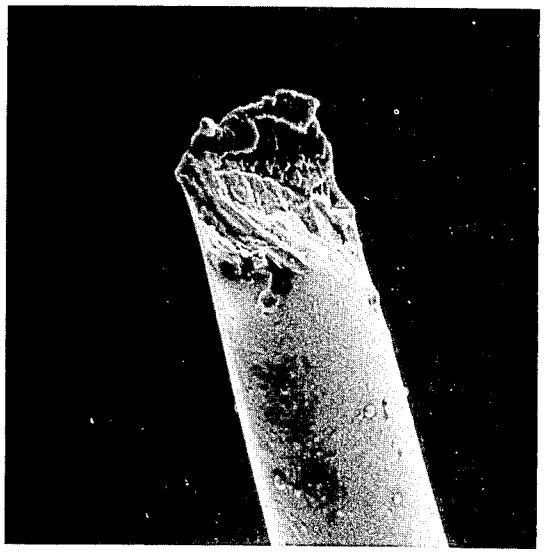
FIGS. 5*c* and 5*d* are the photographs similar to FIGS. 5*a* and 5*b*, in which the pile forming filaments are made by crystallization drawing according to the present invention.
Figure 5D:
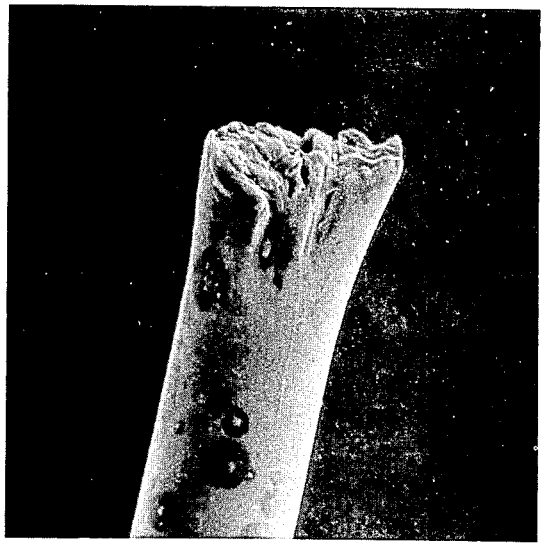

The present inventors have discovered that the thermoplastic synthetic filament utilized for the pile portion of the present invention has a peculiar behavior in elongation thereof. In FIG. 3, reference numeral 1 designates a stress-strain curve of a full drawn yarn usually utilized as a pile of the conventional pile fabric in which a breakage strength is large but a breakage elongation is rather small. Reference numeral 2 designates a similar curve of a half drawn yarn in which the breakage strength and Young's modulus are smaller than those of the full drawn yarn but the breakage elongation is larger. Neither of these two yarns, however, is suitable for the present invention, because the cut end portion of the pile exhibits an undesirable mushroom shape and, expecially in the case of the half drawn yarn, the resultant pile lacks stiffness, tends to fall down, and has a poor bulkiness. Contrary to this, a specially prepared yarn having a stress-strain curve 3 has been found preferable for the present invention. The cut end portion of the third yarn has no mushroom shape but a straight tip, as shown in FIGS. 4*a* and 4*b*.

The mechanism of mushroom formation is considered as follows: When the pile is broken in the raising or shearing process, a breakage stress is applied on the filament and corresponding strain is caused in the filament. The work required for the breakage creates internal heat in the filament, whereby the broken end portion of the filament is plasticized. When the breakage is completed, the stored strain tends to restore the filament structure to its original state. The plasticized end portion is irregularly deformed due to the unevenness of the recovery action of the strain.

The third yarn has a stress-strain curve different from those of the above two yarns, characterized by a smaller breakage strength and a smaller breakage elongation, though the Young's modulus is kept high with the full drawn yarn. Due to this peculiar breakage behavior, the heat generated upon the filament breakage is less than that of the other yarns, because the heat generation corresponds to the amount of work (namely the product of the elongation and the strength), whereby the mobility of the cut end portion is considerably restricted. In addition, since the stiffness of the pile is maintained at the same level as the full drawn yarn due to its higher Young's modulus, the pile shows good bulkiness and stand-up.

The breakage strength $T_2$ of the above yarn utilized for the present invention has to be less than 2.8 g/De, preferably less than 2.3 g/De. The breakage elongation $E_2$ also has to be less than 50%, preferably less than 37%. Further, the primary yielding elongation $E_1$ has to be at most 10%, preferably less than 7%, and the primary yielding strength $T_1$ has to be more than 1.2 g/De. If any of the above parameters is deviated from, the pile will have a rough and mushroom shaped end portion and/or lack stiffness.

The synthetic yarn suitable for the present invention can be prepared by various methods. A preferable method thereof is crystallization drawing, in which an original undrawn and non-oriented yarn is subjected to heat treatment to impart a sufficient degree of crystallization, such as more than 30%, and thereafter is drawn at a certain drawing ratio, such as in a range of from 1.5 to 1.7, so as to obtain a primary yielding strength exceeding 1.2 g/De and a primary yielding elongation less than 10%. Due to the crystallization prior to the drawing, the orientation degree of molecules in the amorphous region and the molecular density are controlled below a certain level and a slippage between the molecules smoothly occurs in the drawing stage, even exceeding the primary yielding point, whereby a breakage elongation not exceeding 50% can be achieved.

Other than the above-described crystallization drawing, high speed spinning and rapid quench spinning can be also adopted for preparing the yarn utilized for the present invention. If the material of the synthetic filament is modified by a third constituent to enhance slippage between the molecules, the above methods can be more effectively carried out.

The first aspect of the present invention will be further illustrated by, but is by no means limited to, the following examples.

EXAMPLE 1

Figure 6:
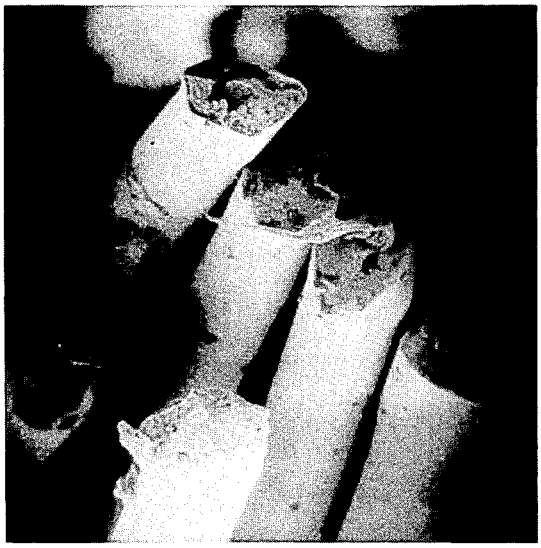
FIGS. 6, 9 and 11 are photographs similar to those before, showing various examples according to the present invention.

An undrawn yarn of 220 De/24 fil composed of polyester containing 2.6 mol % of 5-sodium-sulfo-isophthalate was melt-spun at a rate of 1,200 m/min. The undrawn yarn was drawn with a draw ratio of 2.0 by means of a hot roll of 100° C. temperature and a hot plate of temperature 120° C. The obtained medium oriented yarn having a breakage elongation of 110% was then subjected to heat treatment in a relaxed state of 10% overfeed under a temperature of 200° C. for crystallization. Thereafter, the yarn was subjected to cold-drawing with a draw ratio of 1.6 under room temperature, whereby a final yarn having characteristics of $T_1=1.6$ g/De, $T_2=2.1$ g/De, $E_1=5\%$, and $E_2=30\%$ was prepared. A greige pile fabric was produced by utilizing the thus obtained final yarn as a sinker pile yarn by means of a circular knitting machine. The pile fabric was then subjected to a known shearing process followed by dyeing. The cut pile of the resultant fabric, shown in FIG. 6, had a $d_1/d_2$ value of 1.02, which is in the range of the present invention, and had an excellent surface appearance with a deep color.

COMPARATIVE EXAMPLE 1

Figure 7:
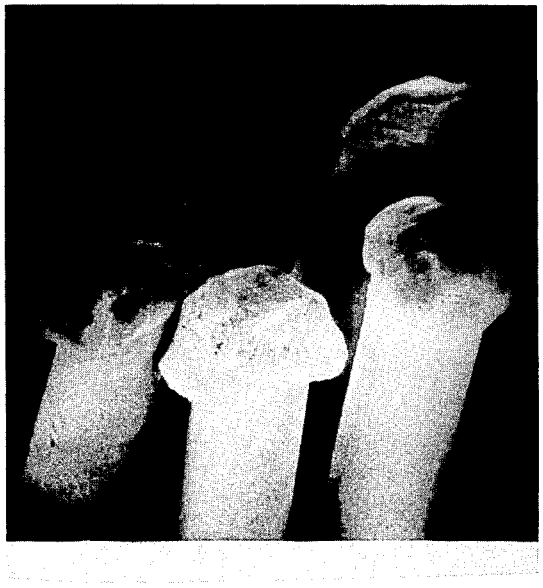
FIGS. 7, 8, and 10 are photographs similar to those before, showing various comparative examples.

The same undrawn yarn as utilized in Example 1 was subjected to a normal drawing process with a draw ratio of 3.0 by means of a hot roll of 85° C. temperature and a hot plate of 180° C. temperature. The obtained full drawn yarn had characteristics of $T_1=3.3$ g/De, $T_2=3.8$ g/De, $E_1=8\%$, and $E_2=27\%$. A comparative pile fabric was prepared in the same manner as for Example 1. The cut pile of the comparative fabric had a mushroom shape, as shown in FIG. 7, with a $d_1/d_2$ value of 1.50, which is outside of the present invention, and had an irregular and dirty appearance caused by light scattering on the pile surface and by foreign matter adhering thereon.

COMPARATIVE EXAMPLE 2

Figure 8:
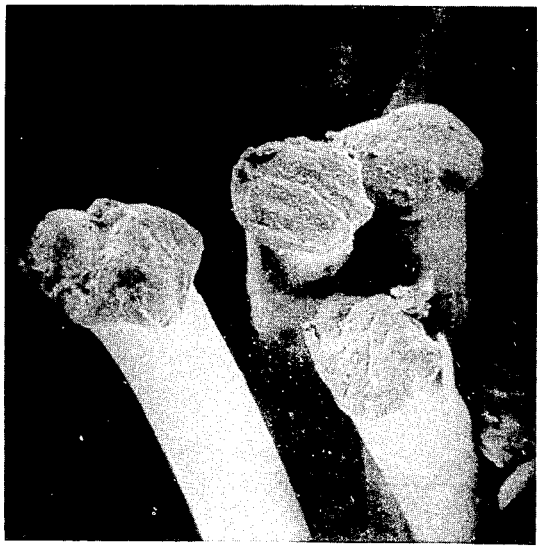

A half drawn yarn was prepared in the same manner as for Comparative Example 1, except that the draw ratio was 2.5. The resultant yarn had characteristics of $T_1=1.2$ g/De, $T_2=2.6$ g/De, $E_1=11\%$, and $E_2=63\%$. A comparative pile fabric was prepared in the same manner as Example 1. The cut pile of the comparative fabric had a mushroom shape, as shown in FIG. 8, with a $d_1/d_2$ value of 1.45. The appearance and touch of the pile surface were unsatisfactory. As is apparent from these results, the required product cannot be obtained merely by lowering the breakage strength of the pile yarn.

EXAMPLE 2

Figure 9:
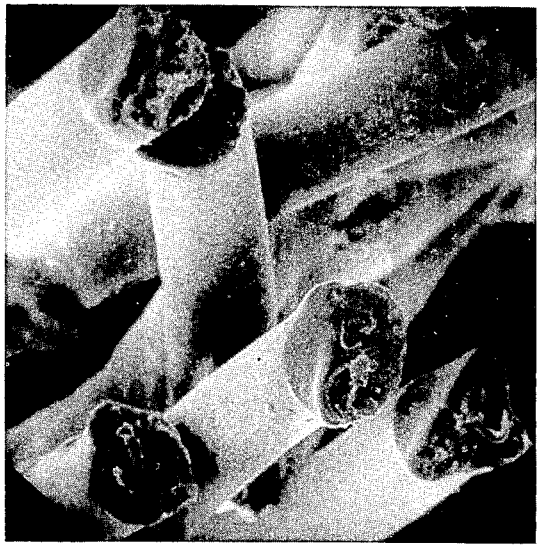

A medium oriented undrawn yarn of 130 De/24 fil composed of pure polyethylene-terephthalate was melt-spun at a rate of 3,000 m/min. The undrawn yarn was subjected to heat treatment in a relaxed state of 15% overfeed under a temperature of 220° C. for crystallization. Thereafter, the yarn was cold-drawn with a draw ratio of 1.6, whereby a final yarn having characteristics of $T_1=1.2$ g/De, $T_2=2.7$ g/De, $E_1=4\%$, and $E_2=25\%$ was prepared. A cut pile fabric was produced in the same manner as for Example 1 by utilizing the thus obtained final yarn as a pile yarn. The cut pile of the resultant example fabric, shown in FIG. 9, had a $d_1/d_2$ value of 1.22, which is in the range of the present invention, and exhibited a good feel.

COMPARATIVE EXAMPLE 3

Figure 10:
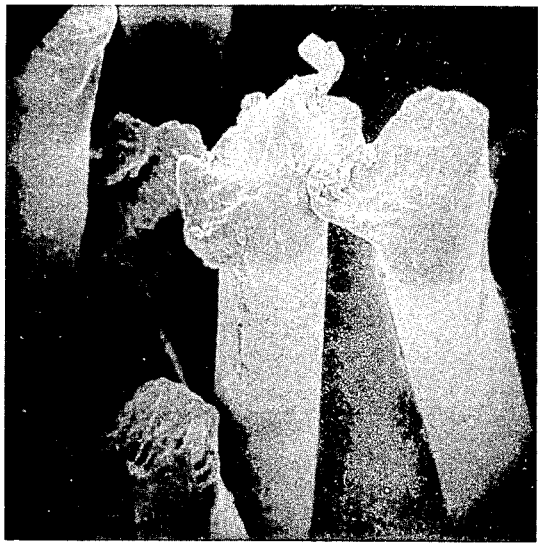

The same medium oriented undrawn yarn as utilized in Example 2 was subjected to a normal drawing process with a draw ratio of 1.5 and a temperature of 160° C. The obtained drawn yarn had characteristics of $T_1=3.6$ g/De, $T_2=4.9$ g/De, $E_1=9\%$, and $E_2=26\%$. A comparative pile fabric was prepared in the same manner as Example 2. The cut pile of the comparative fabric had an irregular tip end portion as shown in FIG. 10. The $d_1/d_2$ value therof was 1.82, which is outside of the present invention. The fabric was unsatisfactory due to lack of color clearness and shade depth as well as rough touch.

EXAMPLE 3

Figure 11:
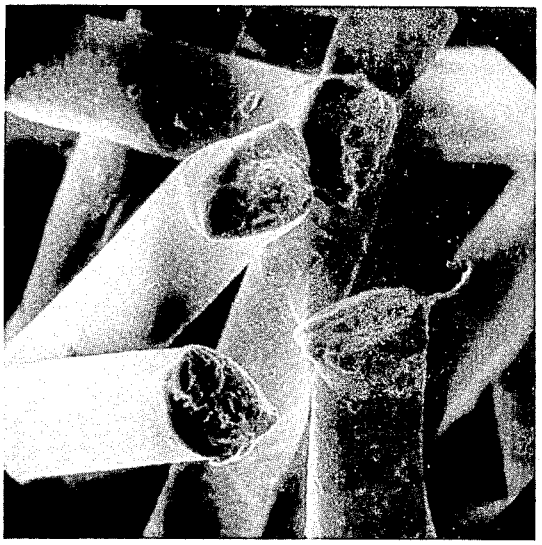

A yarn composed of polyester comprising 3.5 mol % of 5-sodium-sulfo-isophathalate was melt-spun by rapid quench spinning at a rate of 4,000 m/min and, then, was subjected to heat treatment by means of a hot roll of 200° C. temperature for crystallization. Thereafter, it was cooled by a quenching roller. The thus prepared filament yarn had a titre of 75 De/24 fil and characteristics of $T_1=1.4$ g/De, $T_2=1.7$ g/De, $E_1=7\%$, and $E_2=32\%$. A cut pile fabric was produced in the same manner as for Example 1. The cut pile of the fabric shown in FIG. 11 had a straight shape with a $d_1/d_2$ value of 1.05. The fabric was a high grade product with good color depth, luster, and touch.

EXAMPLE 4

An undrawn filament yarn of 300 De/48 fil of cation dyeable polyester containing 2.6 mol % of 5-sodium-sulfoisophthalate was spun at a rate of 1,200 m/min. The undrawn yarn was drawn with a draw ratio of 2.0 through a hot roll of 100° C. temperature and a hot plate of 120° C. temperature to be a medium oriented yarn having an elongation of 110%. Thereafter, the medium oriented yarn was relaxed for crystallization in a 10% slack condition under a 200° C. temperature and, then, was drawn with a draw ratio of 1.6 under room temperature, whereby there was obtained a resultant yarn having characteristics of $T_1=1.7$ g/De, $T_2=2.2$ g/De, $E_1=5\%$, and $E_2=30\%$.

A fabric was produced by a double velvet loom by utilizing the resultant yarn as all component yarns thereof. The fabric was dyed after a uniform cut pile of 2 mm height was obtained by a shearing machine. The thus obtained velvet had a clear cut pile having a $d_1/d_2$ value of 1.03. The appearance and touch of the pile surface were superior to conventional velvet.

COMPARATIVE EXAMPLE 4

An undrawn yarn of 300 De/48 fil of cation dyeable polyester containing 2,6 mol % of 5-sodium-sulfoisophthalate was spun at a rate of 1,200 m/min. The undrawn yarn was drawn with a draw ratio of 3.0 in a known manner through a hot roll of 85° C. temperature and a hot plate of 180° C. temperature, whereby a full drawn yarn was obtained having characteristics of $T_1=3.3$ g/De, $T_2=3.8$ g/De, $E_1=8\%$, and $E_2=27\%$.

A comparative velvet was prepared in the same manner as for Example 4. However, the quality thereof was not as good as in Example 6, especially in the depth of color shade and cleanness of the pile surface.

Figure 12:
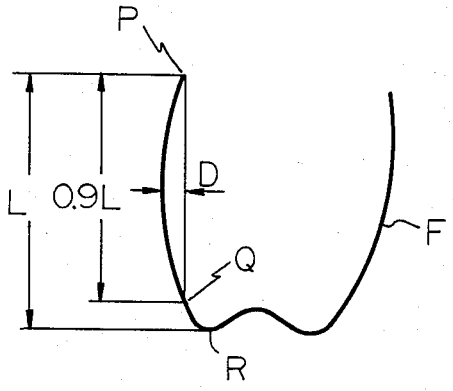
FIG. 12 is a typical view of a pile forming filament taken out from a cut pile fabric with care so that the shape thereof does not deform.

Turning now to a second aspect of the present invention, it is possible to further improve the color depth on the pile surface of the cut pile fabric. This aspect is preferably applied to a velvet type cut pile fabric which includes a thermoplastic synthetic filament yarn at least in a pile portion, as is the case of the first aspect. The pile yarn of this aspect has good linearity even after the fabric is subjected to post heat-treatment. The measure of the linearity is a "deformation factor D", defined as follows with reference to FIG. 12:

A single filament F forming a pile portion is taken out from the cut pile fabric with care not to deform its shape. The filament F is a microscopically photographed and its shape measured by (1) measuring a height L of the filament F, defined as a distance between a tip point P and a bottom point R, (2) determining a point Q on the filament F distant from the tip point P toward the bottom point R at a distance 0.9 L, (3) connecting the two points P and Q with a chord therebetween, and (4) measuring the maximum deviation D between an arc $\widehat{PQ}$ and the chord $\overline{PQ}$.

According to the present invention, the value of D/0.9 L has to be not more than 0.1.

There are many factors lowering the linearity of the pile forming filament. The main factor is release of internal strain stored during a filament making process. Therefore, it is necessary to relax the internal stress of the filament and remove the residual strain therefrom before the filament is incorporated into a pile fabric. The present inventors have found that the released internal strain is larger in the case of a modified polyester comprising a third constituent than in the case of a pure polyester. Uneven distribution of the third constituent in the polymer material, quenching irregularity in the melt spinning process, minor differences of heat career between adjacent portions of the filament created in a hot drawing process and so on cause uneven strain in the continuous filament, such strain being released after the filament is incorporated in the fabric by heat treatment under a relaxed condition such as scouring, dyeing, or heat setting. Therefore, according to the present invention, it is necessary to utilize a filament free from irregular internal strain as a pile forming yarn. Such an improved filament can be obtained by subjecting a normally drawn thermoplastic synthetic filament yarn to a further heat setting before being incorporated in a pile fabric.

Any type of heat treatment can be adopted for this purpose, such as a continuous process in which the yarn is treated in a running state passing through a nontouch type heater or a touch type heater such as a hot plate or a hot roll, or a batch process in which the yarn is treated in the form of reel or package.

Figure 13:
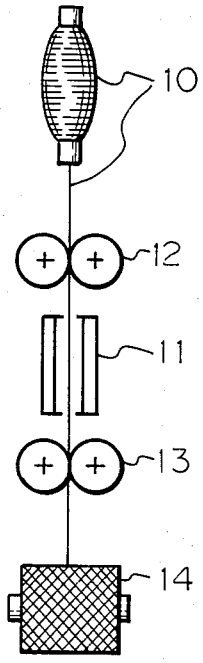
FIG. 13 is a schematic side view of a heat-setting process for preparing a thermoplastic synthetic yarn utilized as a pile forming yarn of the present invention.
Figure 14A:
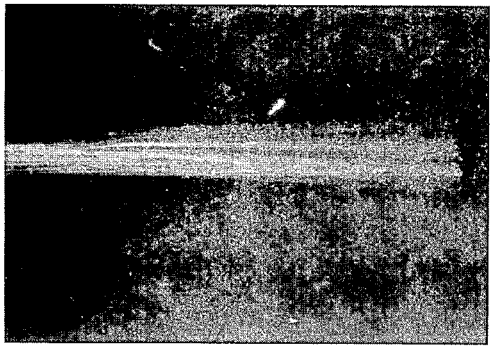
FIGS. 14*a* to 14*c* are microscopic photographs of deformation degrees of one example of a pile forming yarn according to the present invention.
Figure 14B:
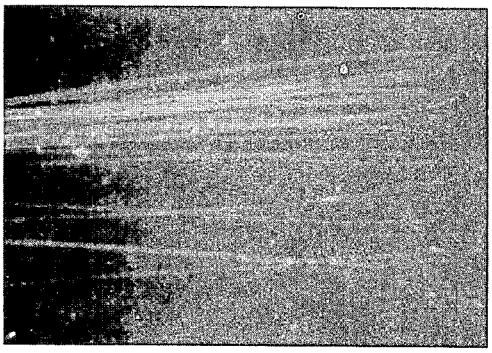
Figure 14C:
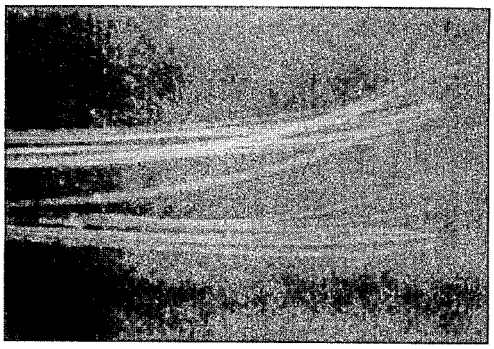

FIG. 13 illustrates a preferable heat setting process utilized for the above purpose. An original yarn 10 prepared by a normal spinning and drawing process is continuously heated by a heater 11 disposed between a roller pair 12 and another roller pair 13 and is wound on a package 14 held on a winder. Care must be taken in the heat treatment so that the yarn 10 is relaxed in the heater 11 while maintaining its linearity (in other words, while preventing free bending). This state can be achieved by overfeeding the yarn 10 by the roller pair 12 relative to the roller pair 13 at a proper degree.

Contractions of the resultant yarn in boiling water and in hot air of 160° C. are adopted as measures of residual internal strain. According to the second aspect of the present invention, the resultant yarn utilized as a pile forming filament necessarily has a boiling water contraction of less than 3.0%, preferably less than 2.0% and a hot air contraction at 160° C. of less than 5.0%, preferaby less than 3.0%.

Any thermoplastic synthetic filament yarn can be utilized for the second aspect of the present invention, however, polyester is preferably due to its excellent stiffness and good functionability. An especially preferred polyester is a modified one containing a third constituent for improving dyeability thereof. Such an improvement is particularly desirable for a cut pile fabric such as a velvet because the dyeing can be carried out under atmospheric pressure.

As stated before, the modified polyester has a greater tendency of deformation compared to a pure one. Accordingly, the present invention is particularly effective if applied to modified polyester having a modification constituent of at least 3.0 mol %. A 5-sodium-sulfo-isophthalate is the most preferable constituent for modifying the polyester to affinity to a cationic dye so that excellent color clearness of the pile surface can be obtained in the dyed fabric.

Velvet, particularly one manufactured by a double velvet loom, is the most desirable pile fabric for the application of the second aspect of the present invention because it should have piles of uniform arrangement and of high density.

Effects of the present invention will be described below with reference to microscopic photographs in FIGS. 14*a* to 21 showing the shapes of the pile forming filament according to examples of the second aspect of the present invention and comparative examples thereof.

Two example yarns A and B were prepared by means of the process illustrated in FIG. 13 with an original filament yarn of 120 De/36 fil composed of cation dyeable polyethylene terephthalate modified by 2.6 mol % of 5-sodium-sulfo-isophthalate. Process conditions and characteristics of the resultant yarns are listed in Table 2.

TABLE 2

| Item | Original yarn (Com. Ex.) | Ex. A | Ex. B |
|---|---|---|---|
| Heater temperature | — | 230° C. | 230° C. |
| Treating time | — | 0.6 sec. | 0.6 sec. |
| Overfeed rate | — | 0% | 8% |
| Winding speed | — | 100 m/min. | 100 m/min. |
| Strength | 137 g | 139 g | 138 g |
| Elongation | 33% | 35% | 31% |
| Contraction in boiling water | 5.6% | 1.9% | 1.0% |

TABLE 2-continued

| Item | Original yarn (Com. Ex.) | Ex. A | Ex. B |
|---|---|---|---|
| Contraction in 160° C. hot air | 7.8% | 2.4% | 1.1% |

Figure 15A:
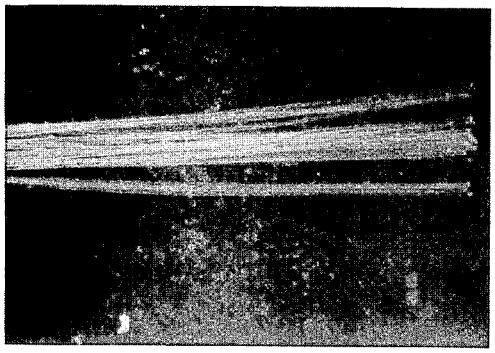
FIGS. 15*a* to 15*c* are photographs similar to FIGS. 14*a* to 14*c* regarding another example yarn.
Figure 15B:
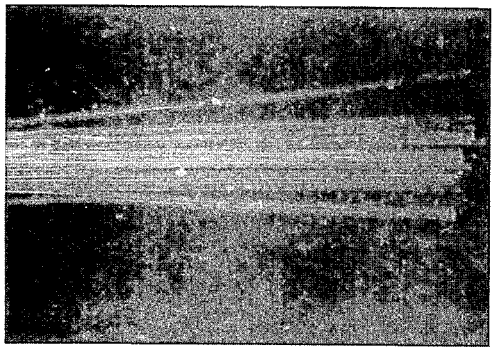
Figure 15C:
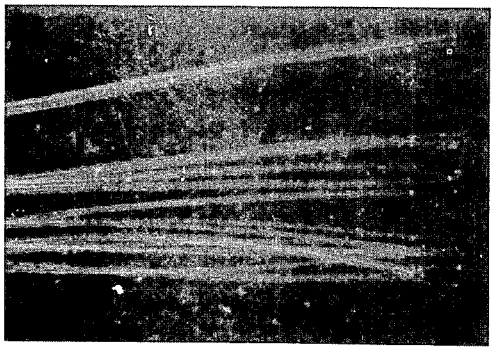
Figure 16A:
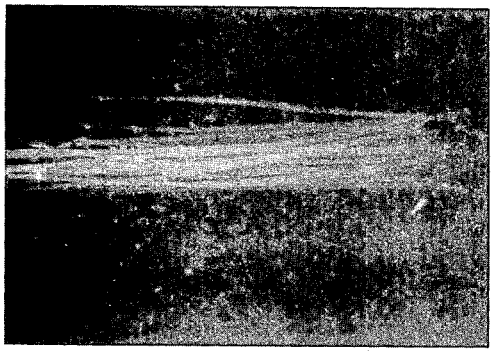
FIGS. 16*a* to 16*c* and 17*a* to 17*c* are photographs similar to FIGS. 14*a* to 14*c* regarding, respectively, two comparative examples other than the present invention.
Figure 16B:
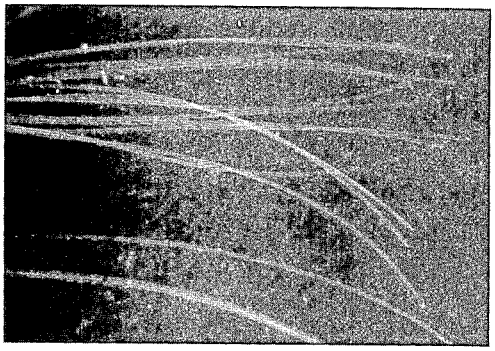
Figure 16C:
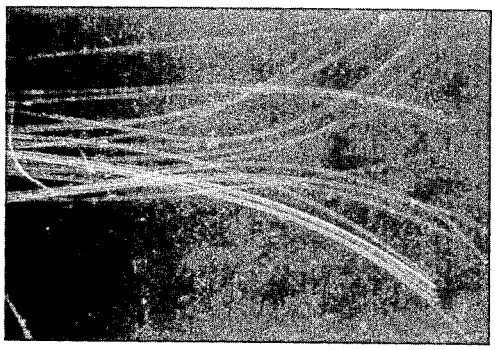

To clarify the thermal behavior of the specially prepared yarn for the present invention, an experiment was conducted in which the example yarns A and B and the original yarn were subjected to various heat treatments of different temperature levels under a non-restricted state. The various deformation degrees of the example yarn A are shown in microscopic photographs in FIGS. 14*a* to 14*c*, in which Figures suffix a denotes a state before heat treatment, b denotes a state after heat treatment of 160° C., and c denotes a state after heat treatment of 180° C. Similarly, FIGS. 15*a* to 15*c* show the example yarn B, and FIGS. 16*a* to 16*c* show the original yarn as a comparative example, in which suffixes a, b, or c in the figure numbers have the same meanings as stated above. As is apparent from the drawings, both of the example yarns, especially B, deform to a lesser extent compared to the comparative example.

Figure 17A:
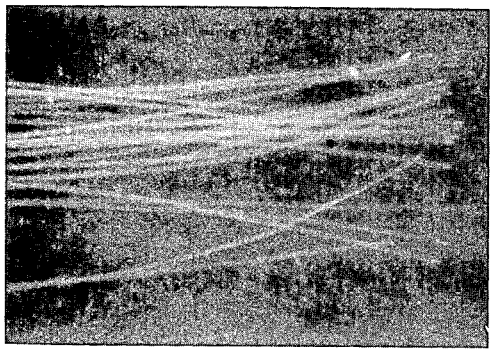
Figure 17B:
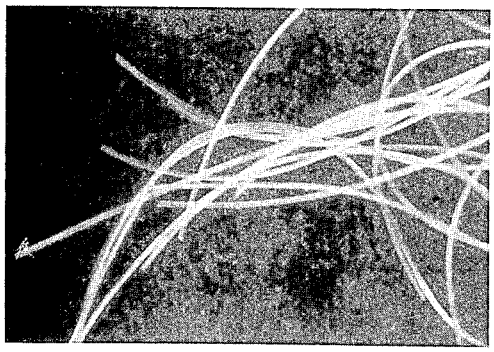
Figure 17C:
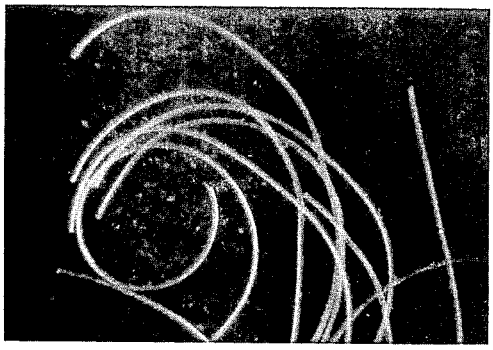

FIGS. 17*a* to 17*c* show the deformation degrees of another comparative yarn prepared from a cation dyeable polyester including 5 mol % of 5-sodium-sulfoisophthalate. In this case, the deformation is greater than that of the prior examples. The suffixes in the Figures have the same meanings as stated before.

Two samples I and II of velvet were prepared by utilizing, respectively, the example yarn B and the original yarn thereof as a pile warp according to the following items:

Original Fabric
- Ground warp: non-heat set cation dyeable polyester filament yarn of 100 De/48 fil
- Weft: same as above
- Warp density: 90.6 end/3.97 cm
- Weft density: 140 end/3.79 cm
- Kind of loom: double velvet loom Post Treatment
- Scouring: 90° C.
- Heat-setting: 170° C.
- Dyeing: 98° C.×60 min.

Figure 18:
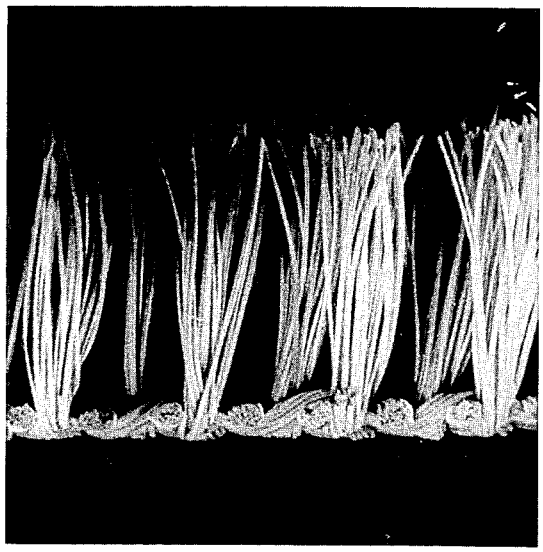
FIG. 18 is a microscopic photograph of a side section of a cut pile (velvet) fabric according to the present invention.
Figure 19:
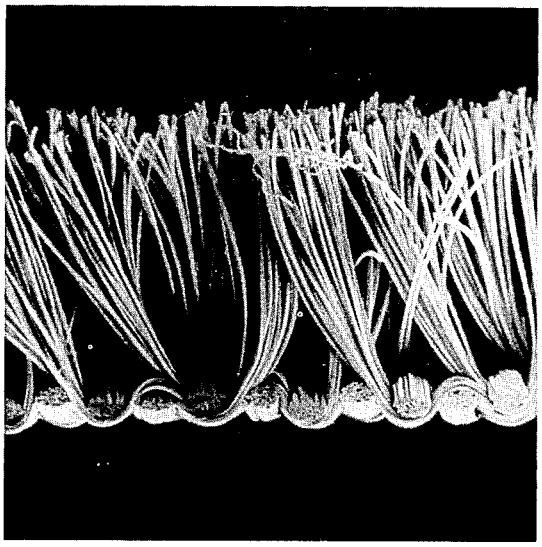
FIG. 19 is a photograph similar to FIG. 18 of a comparative example.
Figure 20:
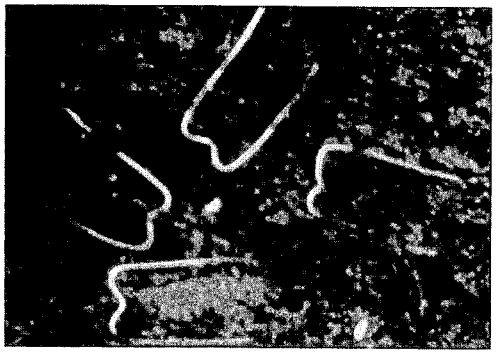
FIG. 20 is a microscopic photograph of a pile forming yarn taken out from the fabric shown in FIG. 18.
Figure 21:
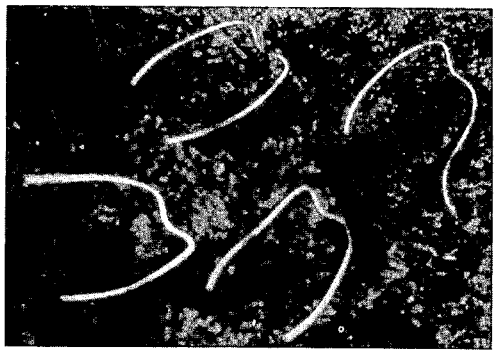
FIG. 21 is a photograph similar to FIG. 20 of the comparative example shown in FIG. 19.

Microscopic photographs of sections of the samples I and II are shown in FIGS. 18 and 19, respectively. As is apparent from the photographs, the pile of sample I exhibits a better linearity compared to sample II. To estimate the linearity thereof more accurately, a plurality of the pile forming filaments were taken out from the samples I and II as shown in FIGS. 20 and 21, respectively. Then, the deformation factor D was determined therefrom. The data of the value of D/0.9 L are listed in Table 3.

TABLE 3

| Data | Sample I (Invention) | Sample II (Com. Ex.) |
|---|---|---|
| 1 | 0.01 | 0.13 |
| 2 | 0.05 | 0.08 |
| 3 | 0.02 | 0.19 |
| 4 | 0.03 | 0.15 |
| 5 | 0.01 | 0.06 |
| 6 | 0.06 | 0.10 |
| 7 | 0.04 | 0.12 |
| 8 | 0.01 | 0.17 |
| 9 | 0.00 | 0.09 |
| 10 | 0.02 | 0.14 |

TABLE 3-continued

| Data | Sample I (Invention) | Sample II (Com. Ex.) |
|---|---|---|
| Average | 0.025 | 0.123 |

It will be understood therefrom that the value of d/0.9 L shows good conformity with the results of a sensual test. According to further tests on samples prepared by varying conditions of heat treatment, it has been found that the value d/0.9 L should be not more than 0.1 in order to achieve the object of the second aspect of the present invention.

Effects of the second aspect of the present invention will be apparent according to the following examples:

EXAMPLE 5

The cation dyeable polyester filament yarn utilized in Example 1 was further heat-set by wrapping it around a hot roll of 220° C. temperature so that the yarn had contraction properties of 1.5% and 2.8%, respectively, in boiling water and 160° C. hot air. A pile fabric was prepared with the resultant yarn as a sinker pile in the same manner as Example 1. The pile surface thereof exhibited an elegant appearance with deep color shade due to the multiplied effect of the Cclear cut end and the good linearity of piles. In this connection, the value of $d_1/d_2$ was 1.02 and the value of D/0.9 L was 0.04.

EXAMPLE 6

A polyester filament yarn utilized in Example 2 was further heat-set by means of the process shown in FIG. 13, in which the yarn runs through a slit heater of 240° C. temperature at an overfeed rate of 2.0%. Even in the overfed state, the yarn could pass the heater with a straight condition thereof because the yarn contracts in the heater. Thus, the resultant yarn had contraction properties of 1.7% and 2.4%, respectively, in boiling water and 160° C. hot air. A pile fabric was prepared with the resultant yarn as a sinker pile in the same manner as for Example 1. The pile surface thereof showed excellent appearance, especially in deep color shade. In this example, the value of $d_1/d_2$ was 1.19 and the value of D/0.9 L was 0.08.

EXAMPLE 7

The resultant yarn according to Example 4 was further subjected to heat treatment by means of a hot roll of 220° C. temperature to be a heat-set yarn having contraction properties of 1.5% and 2.8%, respectively, in boiling water and 160° C. hot air. Velvet was prepared in the same manner as for Example 6. The velvet had better qualities than Example 6 due to the multiplied effect of the undeformed end and the good linearity of the piles. In this regard, the value of $d_1/d_2$ was 1.02 and the value of D/0.9 L was 0.05.

According to the present invention, since the cut piles of the pile fabric have no mushroom shaped tip portions, the pile surface of the fabric has a good and smooth touch as well as deep color shade. Further, the piles have a better linearity even after being subjected to post heat-treatment, whereby the appearance of the fabric is improved to a great extent.

We claim:

1. A pile fabric comprising a plurality of piles of thermoplastic synthetic fiber having a breakage strength of less than 2.8 g/De, a primary yield strength of more than 1.2 g/De, a primary yield elongation of at least 10%, and a boiling water contraction of less than 3.0% or a hot air contraction at 160° C. of less than 5.0%, at least 50% of the piles being cut piles having cut ends at tip portions thereof, characterized in that an average value of a maximum diameter $d_1$ of said tip portions of said cut piles satisfies the equation $$d_1/d_2 32\ 1.3,$$

where $d_2$ is the average value of a diameter of the remaining portion of said cut piles other than said tip portions.

2. A pile fabric according to claim 1, characterized in that said cut piles have a deformation factor D satisfying the equation $$D/0.9\ L \leqq 0.1$$

where the deformation factor D is the maximum distance between a chord and an arc, both connecting a tip point P and a middle point Q of said cut piles, said point Q being distant from said tip point P toward a bottom point R of said cut piles at a length of 0.9 L, wherein L corresponds to a height of said cut piles measured from said points P and R.

3. A pile fabric according to claim 2, characterized in that said pile fabric is a velvet.

4. A pile fabric according to claim 1, characterized in that said thermoplastic synthetic fiber is a polyester fiber.

5. A pile fabric according to claim 4, characterized in that said polyester fiber is a modified polyester containing a third constituent.

6. A pile fabric according to claim 5, characterized in that the content of said third constituent is not less than 3 mol %.

7. A pile fabric according to claim 5, characterized in that said third constituent is 5-sodium-sulfoisophthalate.

8. A method for producing a pile fabric according to claim 1, characterized by comprising steps of: weaving or knitting an original fabric by utilizing, as a pile forming yarn, a thermoplastic synthetic yarn produced by heat setting a drawn filament yarn and having a breakage strength of less than 2.8 g/De, a primary yielding strength of more than 1.2 g/De, a breakage elongation of less than 50%, a primary yielding elongation of less than 10%, and a boiling water contraction of less than 3.0% or a hot air contraction at 160° C. of less than 5.0% and shearing piles of said original fabric.

9. A method according to claim 8, characterized in that said pile forming yarn is a thermoplastic synthetic yarn produced by utilizing a crystallization drawing system.

10. A method according to claim 8, characterized in that said pile forming yarn is a thermoplastic synthetic yarn produced by utilizing a high speed spinning system.

11. A method according to claim 8, characterized in that said pile forming yarn is a thermoplastic synthetic yarn produced by utilizing a rapid quench spinning system.

12. A method according to claim 8, characterized in that said pile forming yarn is a thermoplastic synthetic yarn modified by a third constituent.

* * * * *